US011088477B2

(12) United States Patent
Yamamoto et al.

(10) Patent No.: US 11,088,477 B2
(45) Date of Patent: Aug. 10, 2021

(54) BOARD-MOUNTED SHIELDED CONNECTOR

(71) Applicant: Tyco Electronics Japan G.K., Kawasaki (JP)

(72) Inventors: Tohru Yamamoto, Kawasaki (JP); Hitoshi Horita, Kawasaki (JP)

(73) Assignee: Tyco Electronics Japan G.K., Kawasaki (JP)

( * ) Notice: Subject to any disclaimer, the term of this patent is extended or adjusted under 35 U.S.C. 154(b) by 0 days.

(21) Appl. No.: 16/818,436

(22) Filed: Mar. 13, 2020

(65) Prior Publication Data

US 2020/0220288 A1 Jul. 9, 2020

Related U.S. Application Data

(63) Continuation of application No. PCT/JP2018/034273, filed on Sep. 14, 2018.

(30) Foreign Application Priority Data

Sep. 15, 2017 (JP) ..... JP2017-178042

(51) Int. Cl.
*H01R 12/00* (2006.01)
*H01R 12/71* (2011.01)
(Continued)

(52) U.S. Cl.
CPC ..... *H01R 12/71* (2013.01); *H01R 13/652* (2013.01); *H01R 13/6582* (2013.01)

(58) Field of Classification Search
CPC ..... H01R 4/64; H01R 23/7073; H01R 13/65802; H01R 23/88; H01R 23/6873
(Continued)

(56) References Cited

U.S. PATENT DOCUMENTS 4,451,107 A * 5/1984 Dola ..... H01R 12/737 439/607.1
4,493,525 A * 1/1985 Hall ..... H01R 9/032 439/607.47
(Continued)

FOREIGN PATENT DOCUMENTS

CN 1097540 A 1/1995
CN 1353476 A 6/2002
(Continued)

OTHER PUBLICATIONS

PCT International Search Report and Written Opinion, International App No. PCT/JP2018/034273, dated Nov. 15, 2018, 7 pages.
(Continued)

*Primary Examiner* — Thanh Tam T Le
(74) *Attorney, Agent, or Firm* — Barley Snyder

(57) ABSTRACT

A board-mounting type shield connector includes a contact, a housing supporting the contact and having a mating opening, a shield shell surrounding the housing and having a first board connection portion in a vicinity of a rear end portion of the shield shell, an enclosure having a plugging passage for plugging of a mating connector, and a ground member supported on the enclosure in a vicinity of a front end portion of the enclosure. The plugging passage opens in a frontward direction and communicates with the mating opening. The first board connection portion is connected to a ground pattern on a circuit board. The ground member has a second board connection portion connected to the ground pattern.

15 Claims, 4 Drawing Sheets

(51) Int. Cl.
*H01R 13/652* (2006.01)
*H01R 13/6582* (2011.01)

(58) Field of Classification Search
USPC ..... 439/79, 92, 95, 98, 101, 108, 541.5, 439/607.01, 607.1, 607.35, 607.4, 660
See application file for complete search history.

(56) References Cited

U.S. PATENT DOCUMENTS 4,655,518 A * 4/1987 Johnson ..... H01R 12/737 439/101
4,908,335 A * 3/1990 Cosmos ..... H01R 12/716 439/444
4,959,024 A * 9/1990 Czeschka ..... H01R 13/648 439/607.4
4,995,819 A * 2/1991 Ohl ..... H01R 43/20 439/444
5,104,329 A * 4/1992 Brown ..... H01R 12/716 439/108
5,207,597 A * 5/1993 Kline ..... H01R 13/6582 439/607.38
5,228,871 A * 7/1993 Goodman ..... H01R 13/6593 439/607.56
5,356,301 A * 10/1994 Champion ..... H01R 13/6582 439/108
5,429,520 A * 7/1995 Morlion ..... H01R 12/712 439/108
5,429,521 A 7/1995 Morlion et al.
5,470,238 A * 11/1995 Walden ..... H01R 12/775 439/98
5,500,788 A * 3/1996 Longueville ..... H01R 13/6582 361/800
5,600,544 A * 2/1997 Thalhammer ..... H01R 23/6873 174/351
5,934,939 A * 8/1999 Thenaisie ..... H01R 13/627 439/607.53
5,934,940 A * 8/1999 Maranto ..... H01R 13/74 439/607.25
6,561,849 B2 * 5/2003 Naito ..... H01R 13/6594 439/607.4
6,764,320 B1 * 7/2004 Lenoir ..... H01R 23/688 439/101
7,811,099 B2 10/2010 Lapidot et al.

FOREIGN PATENT DOCUMENTS

CN 106486814 U 8/2016
CN 106486814 A 3/2017
JP 2007141619 A 6/2007
JP 4077721 B2 4/2008
JP 2014232595 A 12/2014

OTHER PUBLICATIONS

Abstract of JP2014232595, dated Dec. 11, 2014, 1 page.
Office Action from National Intellectual Property Administration, P.R. China, dated Jan. 22, 2021, 5 pages.
Abstract of CN205488840, dated Aug. 17, 2016, 1 page.
Abstract of CN 106486814, dated Mar. 8, 2017, 1 page.

* cited by examiner

BOARD-MOUNTED SHIELDED CONNECTOR

CROSS-REFERENCE TO RELATED APPLICATIONS

This application is a continuation of PCT International Application No. PCT/JP2018/034273, filed on Sep. 14, 2018, which claims priority under 35 U.S.C. § 119 to Japanese Patent Application No. 2017-178042, filed on Sep. 15, 2017.

FIELD OF THE INVENTION

The present invention relates to a shield connector and, more particularly, to a shield connector of a type mounted on a board.

BACKGROUND

A board-mounting type of shield connector is mounted on a board. On this board, in a region where the shield connector is mounted, a ground pattern is spread. However, when a piece of electronic equipment internally having the board mounted with the shield connector is placed in a noisy environment, such as in a motor vehicle, for example, the shield connector can also be affected by noise. The noise can contribute to degradation of frequency characteristics of the shield connector.

Japanese Patent Application No. 2014-232595A discloses a coaxial connector having a soldering leg portion of a shield case provided at a rear. In the coaxial connector disclosed in JP 2014-232595A, a ground pattern in a portion facing the coaxial connector becomes an open stub, and acts as a noise-receiving antenna. This contributes to degradation of high frequency characteristics.

SUMMARY

A board-mounting type shield connector includes a contact, a housing supporting the contact and having a mating opening, a shield shell surrounding the housing and having a first board connection portion in a vicinity of a rear end portion of the shield shell, an enclosure having a plugging passage for plugging of a mating connector, and a ground member supported on the enclosure in a vicinity of a front end portion of the enclosure. The plugging passage opens in a frontward direction and communicates with the mating opening. The first board connection portion is connected to a ground pattern on a circuit board. The ground member has a second board connection portion connected to the ground pattern.

BRIEF DESCRIPTION OF THE DRAWINGS

The invention will now be described by way of example with reference to the accompanying Figures, of which.

DETAILED DESCRIPTION OF THE EMBODIMENT(S)

Figure 1:
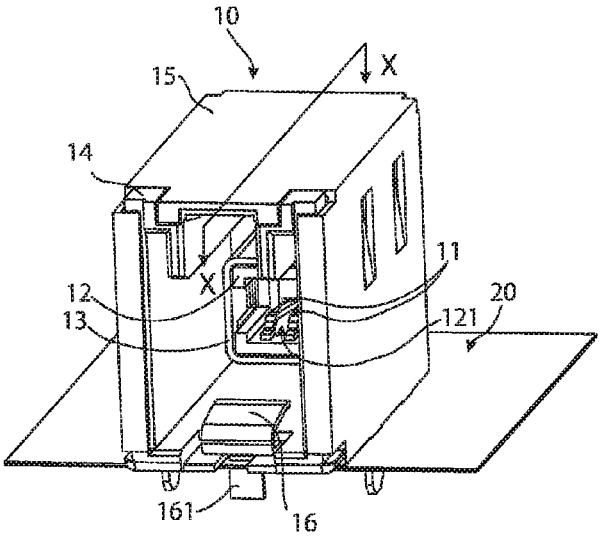
FIG. 1 is a perspective view of a board-mounting type shield connector according to an embodiment.

Exemplary embodiments of the present disclosure will be described hereinafter in detail with reference to the attached drawings, wherein like reference numerals refer to like elements. The present disclosure may, however, be embodied in many different forms and should not be construed as being limited to the embodiments set forth herein; rather, these embodiments are provided so that the present disclosure will convey the concept of the disclosure to those skilled in the art. Furthermore, several aspects of the embodiments may form—individually or in different combinations—solutions according to the present invention. The following described embodiments thus can be considered either alone or in an arbitrary combination thereof.

Figure 2:
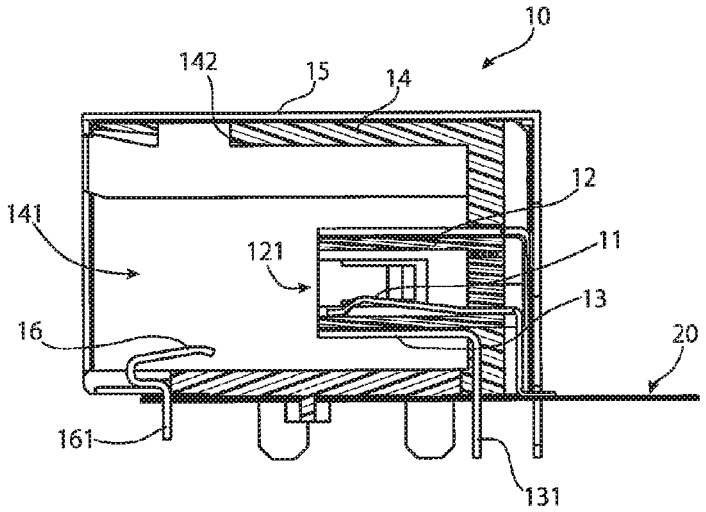
FIG. 2 is a sectional side view of the board-mounting type shield connector, taken along line X-X of FIG. 1.
Figure 3:
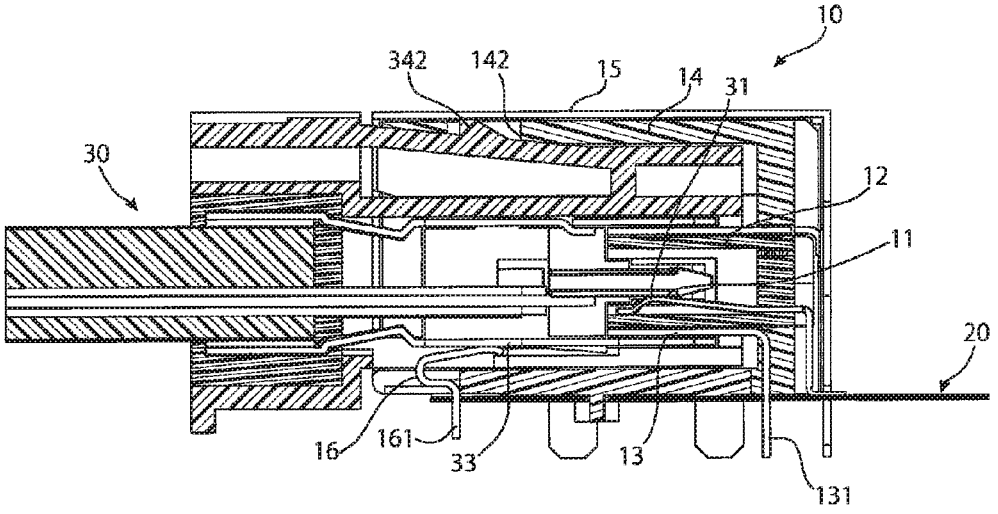
FIG. 3 is a sectional side view of the board-mounting type shield connector taken along line X-X of FIG. 1 in a mated state with a mating connector.

A board-mounting type shield connector 10 according to an embodiment is shown in FIGS. 1-3. The board-mounting type shield connector 10 is shown mounted with a circuit board 20.

The board-mounting type shield connector 10, as shown in FIGS. 1-3, includes a contact 11 made of a metal, a housing 12 made of an insulator supporting the contact 11, and a shield shell 13 made of a metal surrounding the housing 12. The board-mounting type shield connector 10 includes an enclosure 14 made of an insulator accommodating a subassembly composed of the contact 11, the housing 12, and the shield shell 13. A top face, a pair of opposite side faces, and a rear face of the enclosure 14 are covered with a shield plate 15 made of a metal. The board-mounting type shield connector 10 has a ground member 16 made of a metal.

In the embodiment shown in FIGS. 1-3, the board-mounting type shield connector 10 has a pair of contacts 11. The contacts 11 are used for differential signal transmission. Each contact 11 is bent at the rear toward the circuit board 20 and soldered at a lower end portion of the contact 11 to a pad on the circuit board 20, as shown in FIGS. 2 and 3.

The housing 12 supporting the contacts 11, as shown in FIGS. 1 and 2, has a mating opening 121 for mating with a mating connector 30, shown in FIG. 3, that is opened at a front of the housing 12 (a left side as shown in FIGS. 2 and 3).

The shield shell 13 surrounding the housing 12, as shown in FIGS. 1-3, has a rear end portion extending toward the circuit board 20 and a connection portion 131 at the rear end portion soldered to a ground pattern on the circuit board 20. The connection portion 131 may also be referred to as a first board connection portion.

The enclosure 14, as shown in FIGS. 1-3, has a plugging passage 141 for plugging of the mating connector 30. The plugging passage 141 communicates with the mating opening 121 of the housing 12, and is opened frontward (toward the left side in FIGS. 2 and 3). A lock hole 142 for maintaining a mating state with the mating connector 30 is formed in the enclosure 14. As shown in FIG. 3, a lock protrusion 342 of the mating connector 30 extends into the lock hole 142.

The shield plate 15, shown in FIGS. 1-3, covering the enclosure 14 is soldered to the ground pattern on the circuit board 20 at a lower portion of a rear face of the shield plate 15 and at lower portions of a pair of side faces of the shield plate 15. The shield plate 15 further suppresses external noise.

The ground member 16, as shown in FIGS. 1-3, is supported on the enclosure 14. In the ground member 16, a connection portion 161 soldered to the ground pattern on the circuit board 20 is provided in the vicinity of a front end portion of the enclosure 14. The connection portion 161 may also be referred to as a second board connection portion.

As shown in FIG. 3, the mating connector 30 has a mating contact 31 for coming into contact with the contact 11 to establish electrical continuity with the contact 11, and a shield shell 33 for coming into contact with the shield shell 13 to serve as a shield jointly with the shield shell 13. The ground member 16 comes into contact with the shield shell 33 of the mating connector 30 plugged into the plugging passage 141 to electrically connect the shield shell 33 of the mating connector 30 and the ground pattern on the circuit board 20. Both the connection portion 131 of the shield shell 13 and the connection portion 161 of the ground member 16 are soldered to the ground pattern on the circuit board 20.

By configuring the ground member 16 to come into contact with the shield shell 33 of the mating connector 30, the ground member 16 can be reduced in size, as compared with a configuration where it is extended in the board-mounting type shield connector and connected to the shield shell 33. This contributes to structural simplification and weight reduction of the board-mounting type shield connector 10.

Suppose that the ground member 16 is absent and a portion in front of the connection portion 131 of the ground pattern on the circuit board 20 is present as a stub. In this case, also, the shield shell 33 of the mating connector 30 is connected to the ground pattern on the circuit board 20 via the shield shell 13 of this board-mounting type shield connector 10. When a piece of electronic equipment mounted with this connector in the absence of the ground member 16 is placed, for example, in a motor vehicle or the like, it is affected by noise the motor vehicle or the like generates. Then, the ground pattern on the circuit board 20 that is present as a stub acts as a noise-receiving antenna, and affects an electrical signal passing through the contact 11 of the board-mounting type shield connector 10, which causes degradation of the high frequency characteristics.

The ground pattern on the circuit board 20 acts as a noise-receiving antenna even when the ground member 16 is present in the board-mounting type shield connector 10 according to the disclosed embodiments. However, because the length of the ground pattern acting as an antenna (stub) is significantly shortened, the received noise shifts to a high frequency side, as compared with the case where the ground member 16 is absent. The board-mounting type shield connector 10 is connected to the ground pattern on the board 20 via both the first board connection portion in the vicinity of the rear end portion and the second board connection portion in the vicinity of the front end portion. This causes external noise received by the ground pattern acting as an antenna to shift to a high frequency side, as compared with a case where it is connected to the ground pattern on the board only via a soldering connection portion. The effect of the received noise on the electrical signal passing through the contact 11 shifts to the high frequency side, which improves the high frequency characteristics of the board-mounting type shield connector 10.

Figure 4:
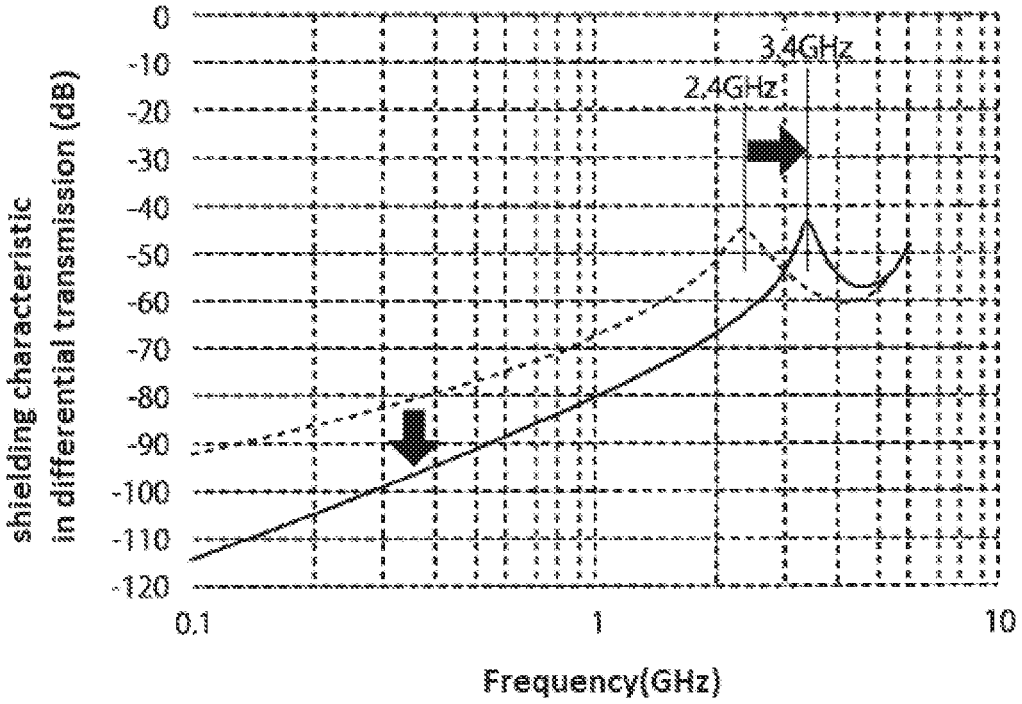
FIG. 4 is a graph of a shielding characteristic in differential transmission of the board-mounting type shield connector.

FIG. 4 is a graph showing a shielding characteristic in differential transmission of the board-mounting type shield connector 10. The horizontal axis of FIG. 4 is the frequency (GHz), and the vertical axis is the shielding characteristic in differential transmission (dB). The shielding characteristic in differential transmission (dB) represents the intensity of noise leaking to the outside of the board-mounting type shield connector 10 because of transmission of a differential signal when the differential signal is transmitted using the two contacts 11. The strength/weakness of noise leaking to the outside immediately corresponds to susceptibility/resistance to external noise. That is, the lower this shielding characteristic in differential transmission (dB), the higher the resistance to external noise becomes, which leads to improvement of the frequency characteristics.

In FIG. 4, two curves in broken line and in solid line are shown. The broken line is the characteristic when the ground member 16 is removed, and the solid line is the characteristic when the ground member 16 is attached. The curve shifts to the high frequency side because of the presence of the ground member 16, and, in comparison at the same frequency, the curve shifts downward, which shows that the high frequency characteristics has been improved.

What is claimed is:

1. A board-mounting type shield connector, comprising:

a contact;

a housing supporting the contact and having a mating opening;

a shield shell surrounding the housing and having a first board connection portion in a vicinity of a rear end portion of the shield shell, the first board connection portion connected to a ground pattern on a circuit board;

an enclosure having a plugging passage for plugging of a mating connector, the plugging passage opened in a frontward direction and communicating with the mating opening; and a ground member supported on the enclosure in a vicinity of a front end portion of the enclosure, the ground member having a second board connection portion soldered to the ground pattern at a position forward of a front facing portion of the front end portion of the enclosure in the frontward direction.

2. The board-mounting type shield connector according to claim 1, wherein the ground member contacts a shield shell of the mating connector plugged into the plugging passage and electrically connects the shield shell of the mating connector and the ground pattern.

3. The board-mounting type shield connector according to claim 1, wherein the contact is a pair of contacts for differential signal transmission.

4. The board-mounting type shield connector according to claim 1, further comprising a shield plate covering the enclosure.

5. The board-mounting type shield connector according to claim 4, wherein the second board connection portion is connected to the ground pattern at a position between a front facing portion of the front end portion of the enclosure and a front end of the shield plate.

6. The board-mounting type shield connector according to claim 1, wherein the ground member is disposed in the plugging passage.

7. The board-mounting type shield connector according to claim 1, wherein the enclosure comprises a top face, a pair of opposing side faces and a rear face defining the plugging passage.

8. The board-mounting type shield connector according to claim 7, further comprising a shield plate covering the top face, the pair of opposing side face and the rear face of the enclosure.

9. The board-mounting type shield connector according to claim 1, wherein the shield shell is arranged on an exterior of the housing.

10. The board-mounting type shield connector according to claim 9, wherein the shield shell includes a bottom wall and two opposing sidewalls arranged about the exterior of the housing.

11. A board-mounting type shield connector, comprising:

a contact;

a housing supporting the contact and having a mating opening;

a shield shell surrounding the housing and having a first board connection portion in a vicinity of a rear end portion of the shield shell, the first board connection portion connected to a ground pattern on a circuit board;

an enclosure having a plugging passage for plugging of a mating connector, the plugging passage opened in a frontward direction and communicating with the mating opening; and a ground member supported on the enclosure in a vicinity of a front end portion of the enclosure, the ground member having a second board connection portion connected to the ground pattern at a position forward of a front facing portion of the front end portion of the enclosure in the frontward direction.

12. The board-mounting type shield connector according to claim 11, wherein the enclosure comprises a top face, a pair of opposing side faces and a rear face defining the plugging passage.

13. The board-mounting type shield connector according to claim 12, further comprising a shield plate covering the top face, the pair of opposing side face and the rear face of the enclosure.

14. The board-mounting type shield connector according to claim 11, wherein the shield shell is arranged on an exterior of the housing.

15. The board-mounting type shield connector according to claim 14, wherein the shield shell includes a bottom wall and two opposing sidewalls arranged about the exterior of the housing.

* * * * *